US006052548A

United States Patent [19]

Yamamoto

[11] Patent Number: 6,052,548

[45] Date of Patent: Apr. 18, 2000

[54] BELT AND CARTRIDGE ARRANGEMENT FOR STORING AND REPLACING A PHOTOSENSITIVE BELT

[75] Inventor: Kazuoki Yamamoto, Niigata, Japan

[73] Assignee: NEC Corporation, Japan

[21] Appl. No.: 09/251,659

[22] Filed: Feb. 17, 1999

[30] Foreign Application Priority Data

Feb. 20, 1998 [JP] Japan ..... 10-054126

[51] Int. Cl.[7] ..... G03G 15/02; G03G 15/00

[52] U.S. Cl. ..... 399/116; 399/107; 399/110; 399/162

[58] Field of Search ..... 399/116, 117, 399/164, 107, 108, 109, 110, 159, 162; 206/303, 493

[56] References Cited

U.S. PATENT DOCUMENTS

| | | | |
|---|---|---|---|
| 4,198,155 | 4/1980 | Silverberg | 399/165 |
| 5,417,322 | 5/1995 | Jeran et al. | 206/303 |
| 5,708,924 | 1/1998 | Shogren et al. | 399/116 |

*Primary Examiner*—Matthew S. Smith
*Assistant Examiner*—Hoang Ngo
*Attorney, Agent, or Firm*—Ostrolenk, Faber, Gerb & Soffen, LLP

[57] ABSTRACT

A flexible, endless photosensitive belt is supported in a printer to form a predetermined traveling trace. This photosensitive belt includes a plurality of belt holes formed in an end portion in a widthwise direction of the photosensitive belt.

13 Claims, 8 Drawing Sheets

BELT AND CARTRIDGE ARRANGEMENT FOR STORING AND REPLACING A PHOTOSENSITIVE BELT

BACKGROUND OF THE INVENTION

The present invention relates to a photosensitive belt for an electrophotographic printer and a belt cartridge for storing the photosensitive belt.

Conventionally, in an electrophotographic printer using a photosensitive belt, when a photosensitive belt can no longer be used as its image quality is degraded due to its service life or the like, the operator directly removes the photosensitive belt manually and exchanges it for a new one.

In the conventional photosensitive belt exchange operation, when a photosensitive belt which can no longer be used because its image quality is degraded, is to be removed, the toner attaching to the photosensitive belt soils the operator's hands.

SUMMARY OF THE INVENTION

The present invention provides a photosensitive belt and a belt cartridge that do not soil the operator's hands when the photosensitive belt is to be removed.

According to the present invention, there is provided a flexible, endless photosensitive belt supported in a printer to form a predetermined traveling trace, comprising a plurality of belt holes formed in an end portion in a widthwise direction of the photosensitive belt.

DESCRIPTION OF THE PREFERRED EMBODIMENTS

The present invention will be described in detail with reference to the accompanying drawings.

First Embodiment

Figure 1:
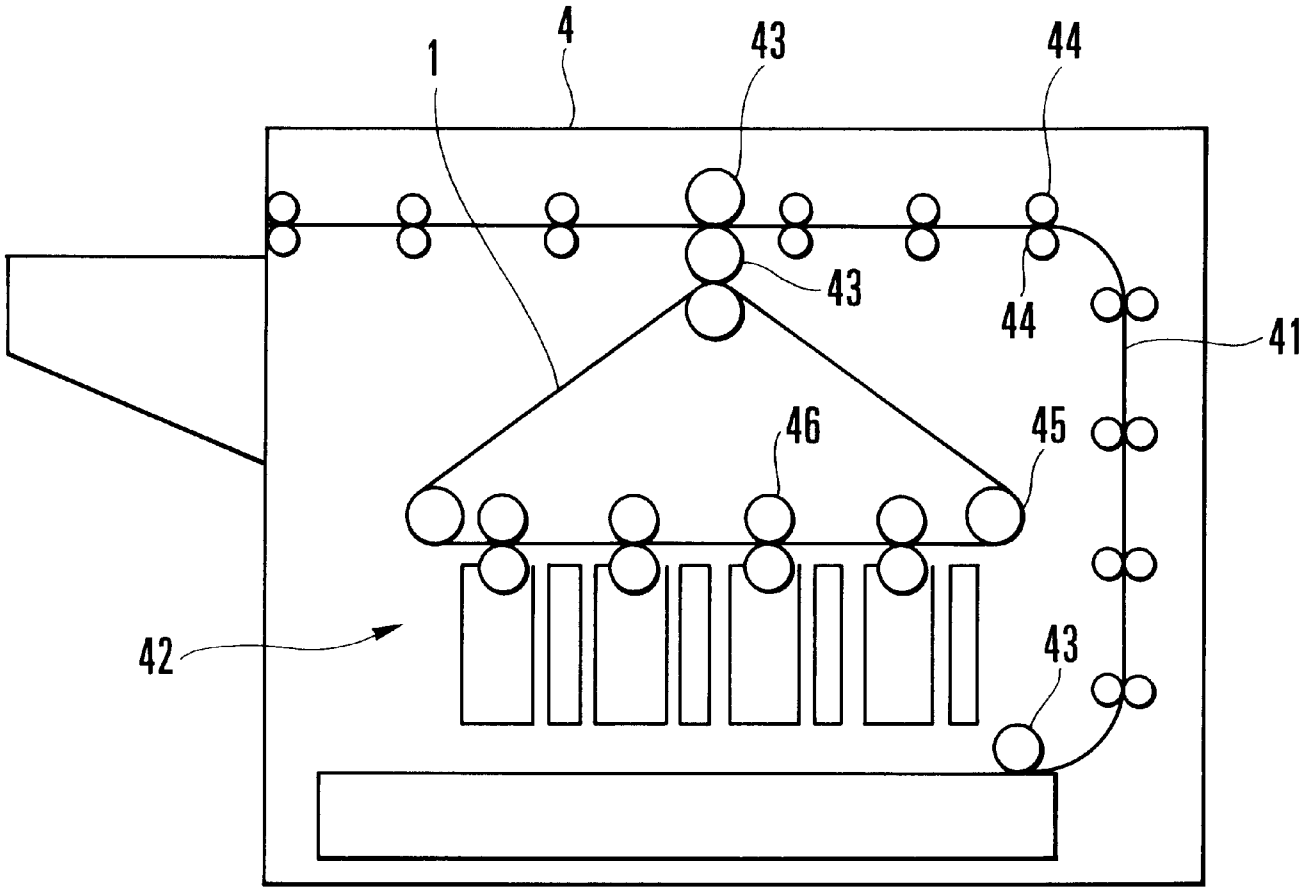
FIG. 1 is a front view schematically showing an electrophotographic printer.

FIG. 1 schematically shows an electrophotographic printer using a photosensitive belt.

Referring to FIG. 1, an electrophotographic printer (to be referred to as a printer hereinafter) 4 prints characters, images, and the like on a paper sheet by using a laser beam. An endless photosensitive belt (to be referred to as a belt hereinafter) 1, a paper convey path 41, and a printing unit 42 are provided in the printer 4. The printer 4 also incorporates paper convey drive rollers 43, paper convey rollers 44, a photosensitive belt drive roller 45, and belt convey rollers 46.

The traveling trace (section of the traveling surface) of the belt 1 forms an isosceles triangle, and a photosensitive layer (not shown) is formed on the surface of the belt 1. The printing unit 42 performs printing through charging, exposure, developing, and cleaning steps for the belt 1 and through transfer and fixing steps for the paper sheet.

Figure 2:
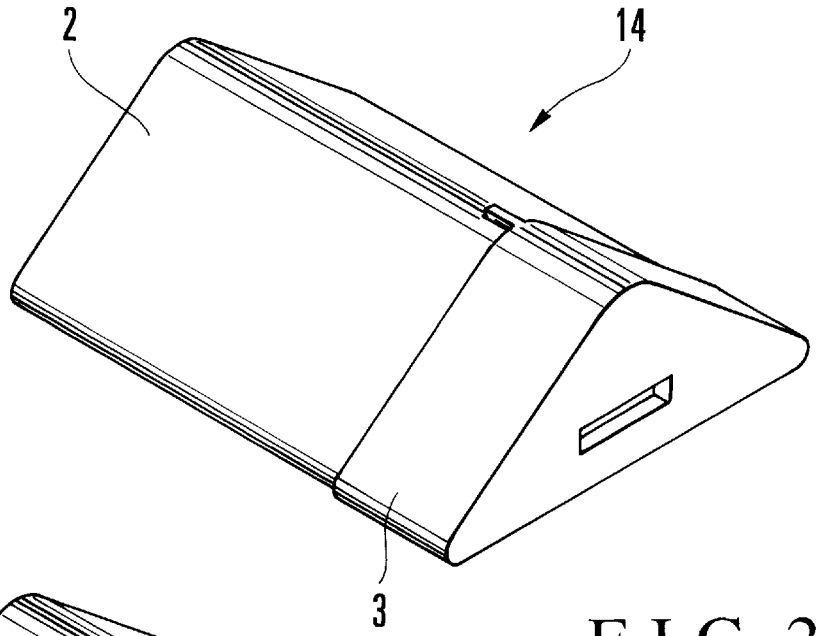
FIG. 2 is a perspective view of a belt cartridge according to the first embodiment of the present invention.

FIG. 2 shows a belt cartridge according to the first embodiment of the present invention.

Before it is mounted in the printer, the belt 1 is stored in a synthetic resin belt cartridge (to be referred to as a cartridge hereinafter) 14 for the purpose of dust prevention and light shielding. The cartridge 14 forms an almost triangular prism, and is constituted by a cartridge main body 2 and a lid 3. The cartridge main body 2 is hollow and forms a bottomed cylindrical shape having one open end face. The lid 3 is fitted on the opening of the cartridge main body 2.

Figure 3:
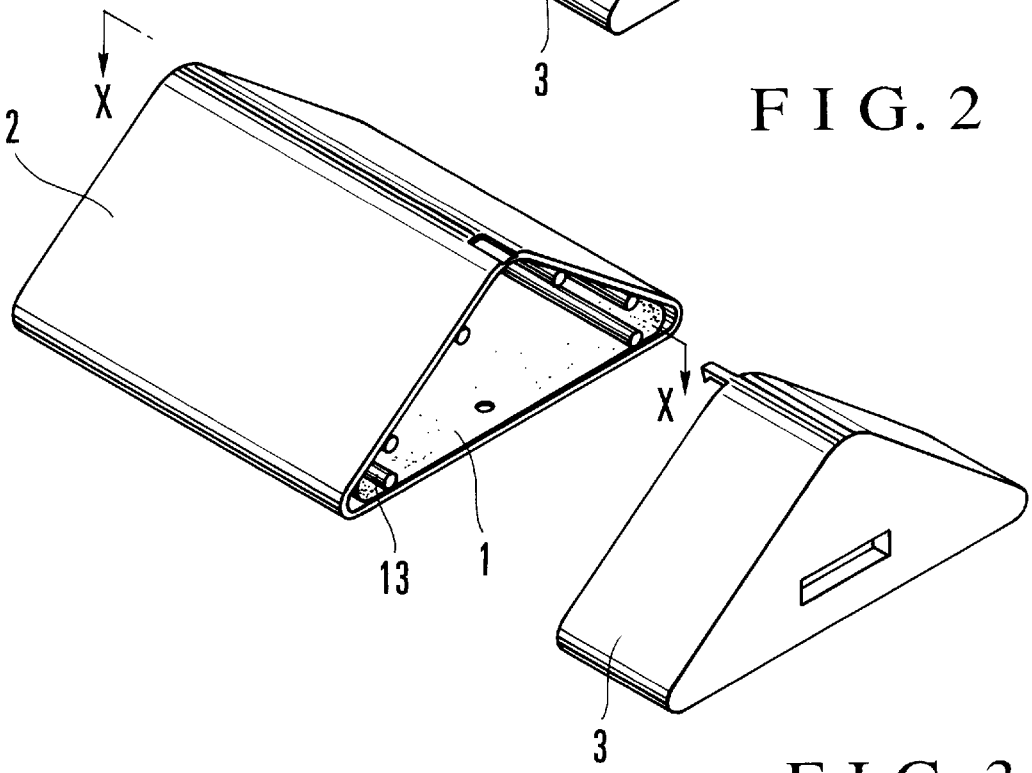
FIG. 3 is a perspective view of the belt cartridge shown in FIG. 2 from which a lid is removed.

As shown in FIG. 3, while it is in stock, the belt 1 is stored in the cartridge main body 2 and held with a plurality of clips 13 such that it forms an isosceles triangle when seen from the side surface. The cartridge main body 2 has an inner circumferential surface slightly larger than the isosceles triangular shape of the belt 1. The opening of the cartridge main body 2 is covered with the lid 3 for the purpose of dust prevention and light shielding.

An example of the belt 1 and cartridge 14 will be described.

Figure 4:
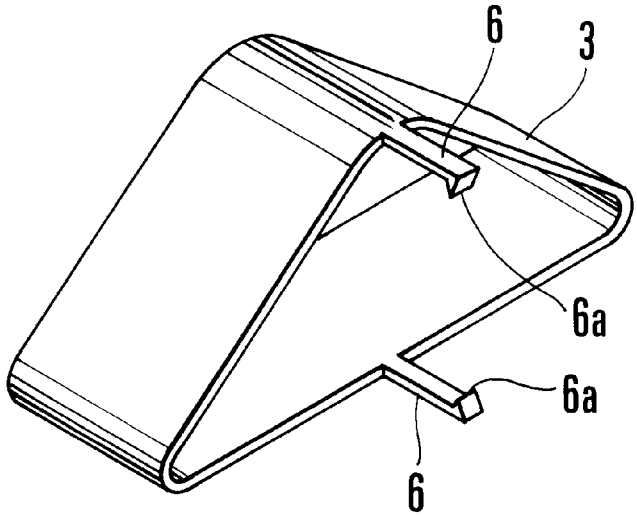
FIG. 4 is a perspective view of the lid of the belt cartridge shown in FIG. 2.
Figure 5:
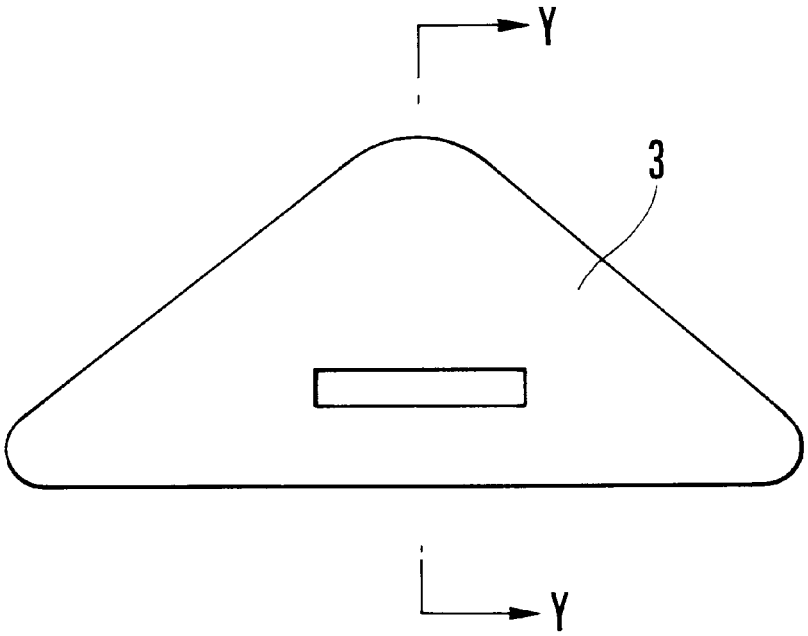
FIG. 5 is a front view of the lid of the belt cartridge shown in FIG. 2.
Figure 6:
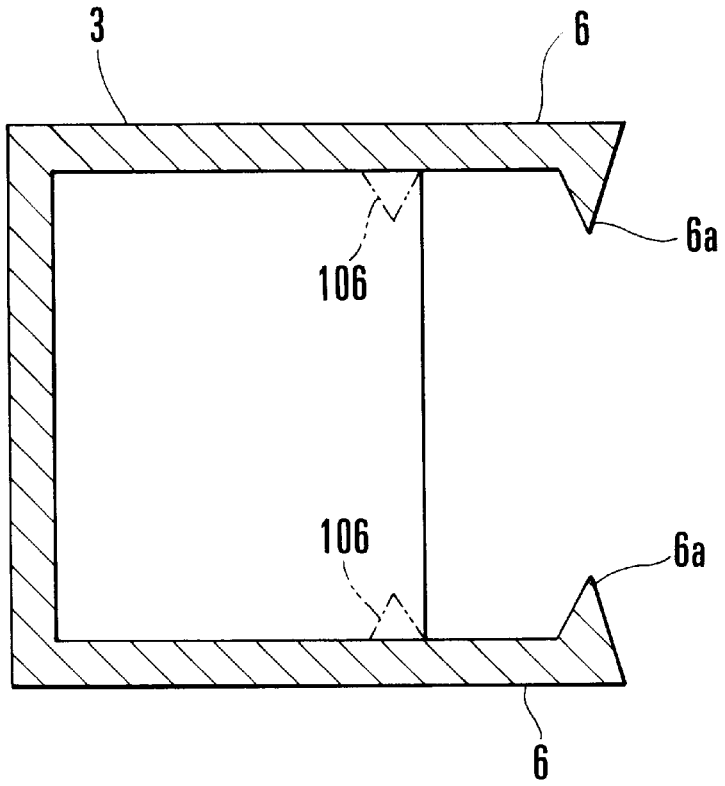
FIG. 6 is a sectional view taken along the line Y—Y of FIG. 5.

As shown in FIGS. 4 and 6, elastically deformable pawl members 6 having jaws 6*a* on their inner sides are formed on the distal end face of the lid 3 of the cartridge 14 to be integral with the lid 3. As shown in FIG. 4, the pawl members 6 are formed at two portions, i.e., at the vertex of the distal end face of the lid 3 forming an isosceles triangle and at the central portion of the bottom side of this isosceles triangle.

Figure 7:
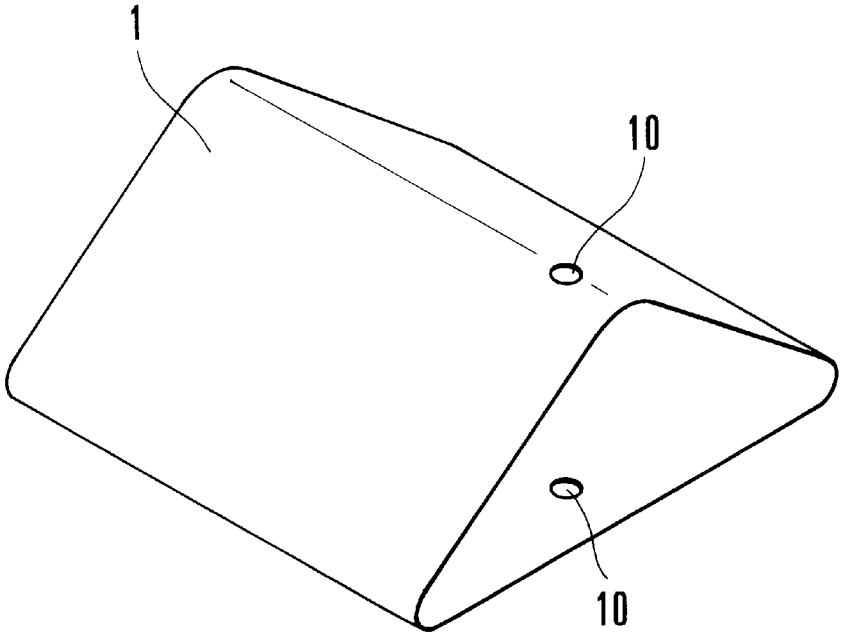
FIG. 7 is a perspective view of a photosensitive belt having belt holes.
Figure 8:
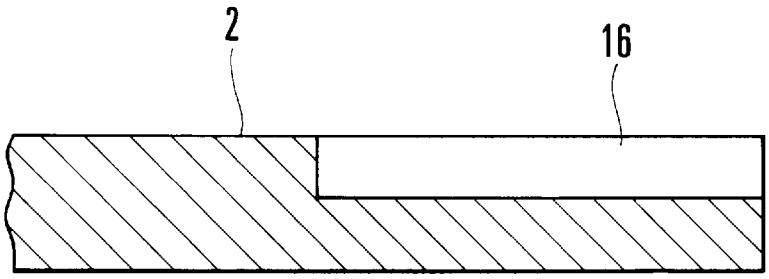
FIG. 8 is an enlarged sectional view of the groove portion of the cartridge main body shown in FIG. 2.
Figure 9:
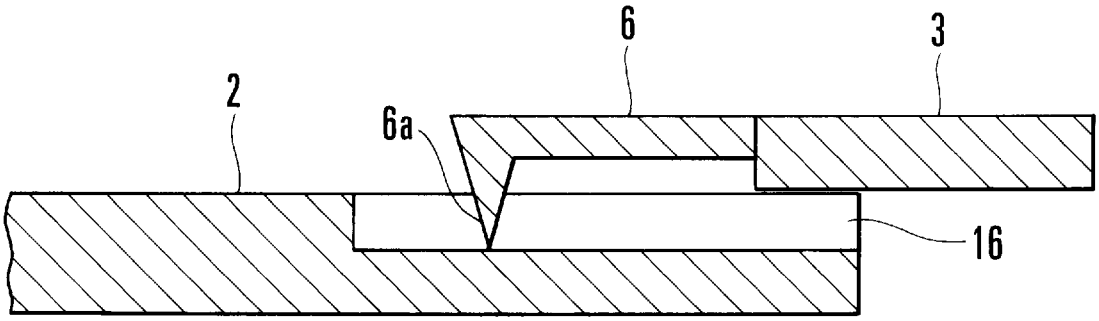
FIG. 9 is a sectional view showing a state wherein the pawl member of the lid is accommodated in the groove of the cartridge main body shown in FIG. 8.

Two belt holes 10 are formed in one side in the widthwise direction of the belt 1, as shown in FIG. 7. The belt holes 10 are formed at positions corresponding to the jaws 6*a* of the pawl members 6 when the lid 3 engages with the belt 1 mounted in the printer 4. As shown in FIGS. 8 and 9, the cartridge main body 2 is formed with two grooves 16 at positions corresponding to the jaws 6*a* of the pawl members 6 on the outer circumferential surface of the cartridge main body 2, to accommodate the jaws 6*a* of the pawl members 6 when the lid 3 is fitted on the cartridge main body 2.

The grooves 16 may be omitted depending on the size or the degree of elastic deformation of the jaws 6*a* of the pawl members 6. The number of belt holes 10 may be equal to the number of the panel members 6. In this case, it suffices if the belt holes 10 are formed at positions equally dividing the length of the belt 1 at a predetermined interval.

The belt 1 is controlled to always stop at the same position when the printing operation of the printer 4 is ended. Hence, the belt holes 10 formed in the belt 1 also always stop at the same positions after the printing operation is ended.

A procedure for removing the belt 1 from the printer 4 will be described.

Figure 10:
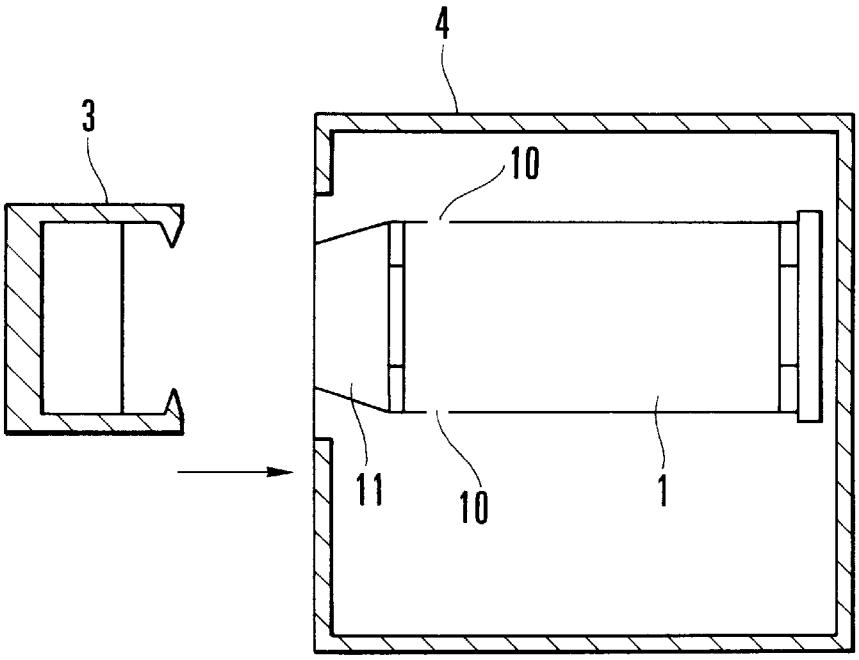
FIG. 10 is a view showing the first step to explain a photosensitive belt removing operation.
Figure 11:
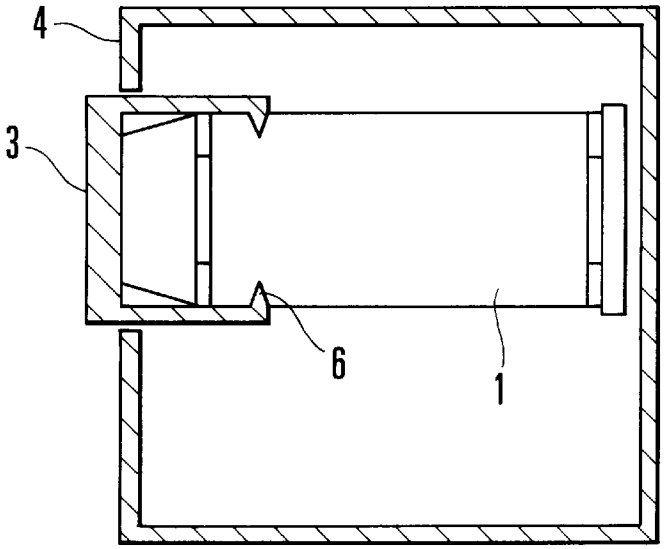
FIG. 11 is a view showing the second step to explain the photosensitive belt removing operation.
Figure 12:
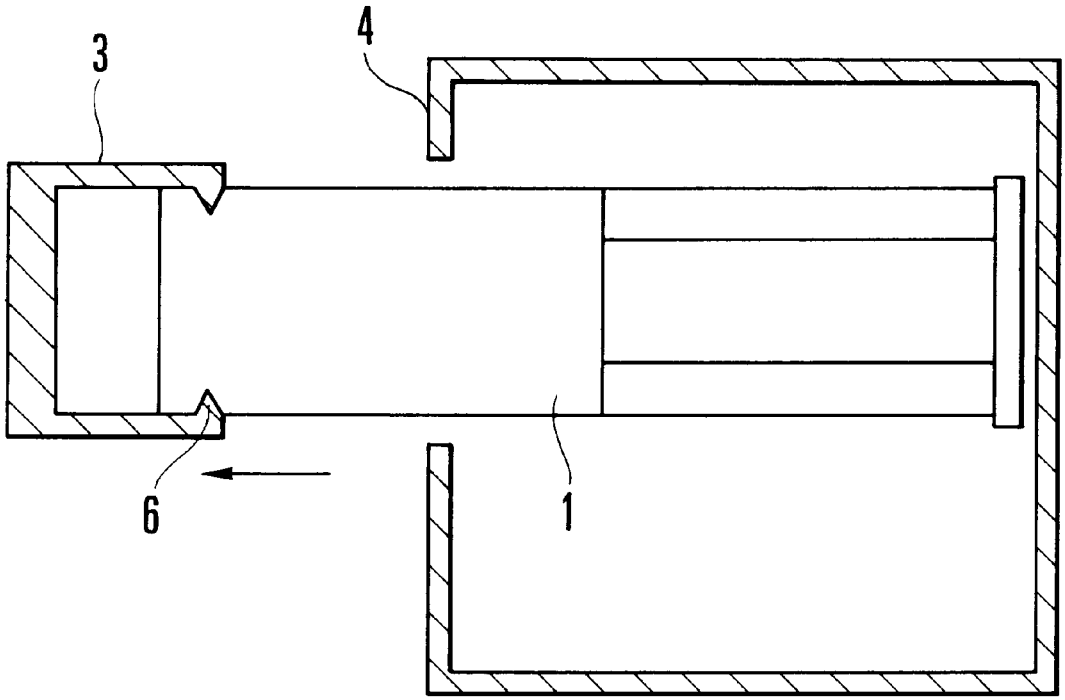
FIG. 12 is a view showing the third step to explain the photosensitive belt removing operation.

In the printer 4, the belt 1 is held by the belt support 11, as shown in FIG. 10. The lid 3 is fitted on the belt support 11 in the direction of an arrow through a printer opening formed in the front surface of the printer 4. When the lid 3 is completely fitted on the belt support 11, the pawl members 6 of the lid 3 engage with the belt holes 10 in the belt 1, as shown in FIG. 11. When the lid 3 is pulled out from the printer 4 in the direction of the arrow, the belt 1 is pulled out, together with the lid 3, with the pawl members 6 of the lid 3 being caught by the belt holes 10 of the belt 1, as shown in FIG. 12.

To exchange the belt 1, the old belt 1 is removed from the printer 4 in accordance with the removing procedure described above. After that, an unused belt 1 is mounted in the printer 4.

With the cartridge of this embodiment, in the electrophotographic printer 4 using the belt 1, when the operator removes the belt 1, to which the toner or the like attaches, from the interior of the printer 4, he pulls out the belt 1 by causing the jaws 6*a* of the pawl members 6 formed on the lid 3 to be caught by the belt 1. Since the operator does not directly touch the belt 1, his hands will not be soiled.

Since the cartridge 14 that has stored the belt 1 is utilized, no exclusive pulling tool is needed. Since the belt 1 pulled out from the printer 4 is stored in the cartridge 14, the belt 1 can be directly disposed of or transported.

The position, shape, number, and the like of the pawl members 6 are not limited to those of the embodiment described above. Although the pawl members 6 are formed on the distal end face of the lid 3, pawls 106 may be directly formed on the inner circumferential surface of the lid 3, as shown in FIG. 6.

Second Embodiment

Figure 13:
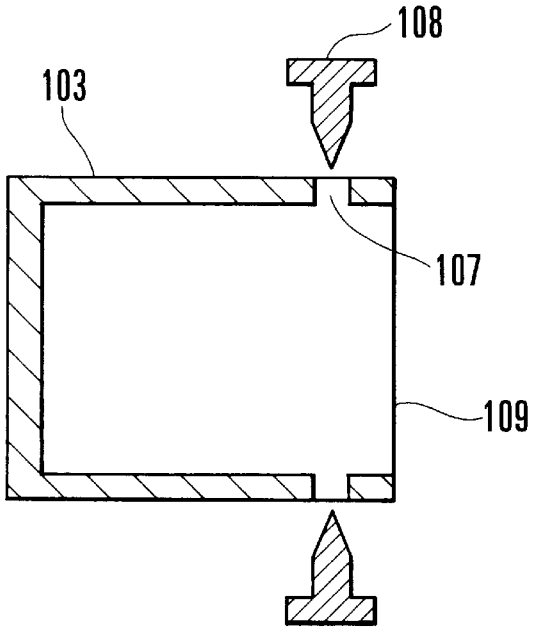
FIG. 13 is a sectional view of the lid of a belt cartridge according to the second embodiment of the present invention.

FIG. 13 shows the lid of a cartridge according to the second embodiment of the present invention.

Figure 14:
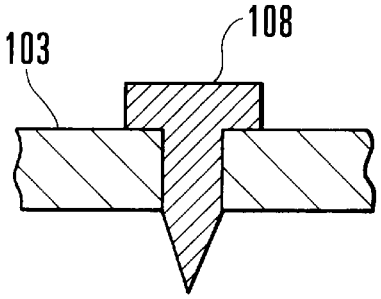
FIG. 14 is a sectional view showing a state wherein a pin is inserted in the hole of the lid of the belt cartridge shown in FIG. 13.

As shown in FIG. 13, a plurality of holes 107 are formed in a lid 103 near its distal end portion 109. As shown in FIG. 14, pins 108 are fitted and fixed in the holes 107. In the same manner as in the first embodiment, belt holes 10 (FIG. 7) are formed in a belt 1 at positions corresponding to the holes 107 of the lid 103.

In the second embodiment, in place of the pawl members 6 of the first embodiment, the distal ends of the pins 108 engage with the belt holes 10 of the used belt 1, to allow the belt 1 to be removed from the interior of the printer 4.

According to this embodiment, the manufacture of the lid 103 becomes easier than that of the pawl members 6 of the first embodiment, to decrease the manufacturing cost. In the first embodiment, if the pawl members 6 are broken, the belt 1 cannot be removed. When the pins 108 are used, such an accident is not likely to occur since they are not broken easily.

The position, shape, number, and the like of the pins 108 are not limited. The pins 108 may be inserted in the belt holes 10 when only the belt 1 is to be removed. In this case, the grooves 16 shown in FIGS. 8 and 9 become unnecessary.

Third Embodiment

Figure 15:
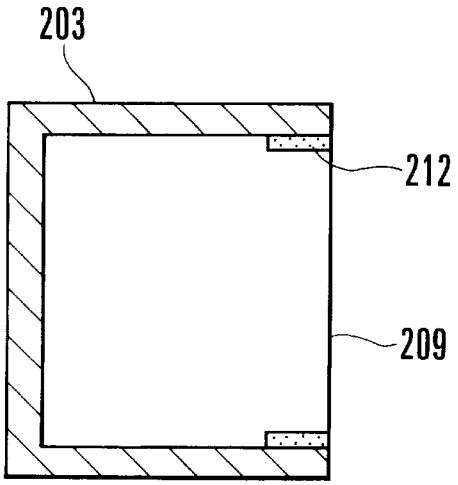
FIG. 15 is a sectional view of the lid of a belt cartridge according to the third embodiment of the present invention.

FIG. 15 shows the lid of a cartridge according to the third embodiment of the present invention.

A double-coated tape 212, one surface of which has release paper, is adhered to the inner side of a lid 203 near its distal end portion 209, as shown in FIG. 15. When removing a belt 1, the release paper is released and the double-coated tape 212 is adhered to the surface of the belt 1, so that the belt 1 can be removed from the interior of a printer 4.

According to this embodiment, since only the double-coated tape 212 need be adhered to the inner side of the lid 203, the structure becomes simple to decrease the manufacturing cost of the cartridge 14. No belt holes 10 need be formed in the belt 1 to decrease the manufacturing cost of the belt 1. Also, the grooves 16 shown in FIGS. 8 and 9 become unnecessary.

The position, shape, number, and the like of the double-coated tape 212 are not limited. The double-coated tape 212 may be adhered to the inner side of the lid 203 when only removing the belt.

As has been described above, according to the present invention, in an electrophotographic printer using a photosensitive belt, when the operator is to remove the photosensitive belt to which a toner or the like attaches from the printer, he does not directly touch the photosensitive belt and thus does not soil his hands.

What is claimed is:

1. A flexible, endless photosensitive belt supported in a printer to form a predetermined traveling trace, said belt comprising a plurality of belt holes formed in an end portion in a widthwise direction of said belt, said belt being removed from said printer by hooking said belt holes with pawl members provided on a lid of a cartridge main body.

2. A belt according to claim 1, wherein said belt holes are formed at a predetermined interval in a traveling direction of said photosensitive belt.

3. A belt according to claim 1, wherein said belt holes are equidistantly formed in a traveling direction of said photosensitive belt.

4. A flexible, endless photosensitive belt supported in a printer to form a predetermined traveling trace, the belt comprising a plurality of belt holes formed in an end portion in a widthwise direction of said photosensitive belt wherein said photosensitive belt is supported in said printer such that a traveling trace thereof forms an isosceles triangle, and said belt holes are formed at a vertex of the isosceles triangle and a center of a bottom side of the isosceles triangle.

5. A cartridge comprising:

a bottomed cylindrical cartridge main body having one open end and an inner circumferential surface slightly larger than a shape of a traveling trace of an endless photosensitive belt supported in a printer;

a lid to fit on the opening of said cartridge main body; and holding means, formed at a distal end portion of said lid, for holding said photosensitive belt when said lid engages with said photosensitive belt supported in said printer.

6. A cartridge according to claim 5, further comprising a plurality of belt holes formed at an end portion in a widthwise direction of said photosensitive belt.

7. A cartridge according to claim 6, wherein said holding means comprises a pawl member having jaws which are formed at a distal end portion of said lid, extend in a direction to fit on said cartridge main body, and project toward an inner side, and said jaws are formed at positions corresponding to said belt holes when said lid engages with said photosensitive belt supported in said printer.

8. A cartridge according to claim 7, further comprising grooves in an outer side surface of said cartridge main body to accommodate said jaws when said lid is fitted.

9. A cartridge according to claim 6, wherein said holding means comprises pawls formed on an inner circumferential surface of a distal end portion of said lid to project toward an inner side, and said pawls are formed at positions corresponding to said belt holes when said lid engages with said photosensitive belt supported in said printer.

10. A cartridge according to claim 6, wherein said holding means comprises a plurality of pin holes formed in a distal end portion of said lid to correspond to said belt holes when said lid engages with said photosensitive belt supported in said printer, and pins inserted in said pin holes.

11. A cartridge according to claim 6, wherein said belt is controlled such that said belt holes always stop at predetermined positions when said printer ends printing.

12. A cartridge according to claim 6, wherein said photosensitive belt is supported in said printer such that a traveling trace thereof forms an isosceles triangle, and said belt holes are formed at a vertex of the isosceles triangle and at a center of a bottom side of the isosceles triangle.

13. A cartridge according to claim 5, wherein said holding means comprises a double-coated tape adhered to an inner circumferential surface of a distal end portion of said lid, and said double-coated tape has one surface covered with release paper when said lid is fitted on said cartridge main body to accommodate said photosensitive belt.

* * * * *